US007681267B1

(12) United States Patent
Hall

(10) Patent No.: US 7,681,267 B1
(45) Date of Patent: Mar. 23, 2010

(54) COLLAPSIBLE AND PORTABLE BABY CHANGING TABLE

(76) Inventor: Carmelina Hall, 12206 Toluca Dr., San Ramon, CA (US) 94583

( * ) Notice: Subject to any disclaimer, the term of this patent is extended or adjusted under 35 U.S.C. 154(b) by 125 days.

(21) Appl. No.: 11/863,154

(22) Filed: Sep. 27, 2007

Related U.S. Application Data

(60) Provisional application No. 60/847,704, filed on Sep. 27, 2006.

(51) Int. Cl.
*A47D 5/00* (2006.01)
*A47C 17/64* (2006.01)
*A47C 19/14* (2006.01)

(52) U.S. Cl. ..... 5/655; 5/115

(58) Field of Classification Search ..... 5/655, 5/114, 115, 120, 122, 127, 129; 297/16.2; 108/118
See application file for complete search history.

(56) References Cited

U.S. PATENT DOCUMENTS

| | | | | | |
|---|---|---|---|---|---|
| 7,712 | A | * | 10/1850 | Whitmarsh | 5/115 |
| 228,920 | A | * | 6/1880 | Murray et al. | 5/115 |
| 244,215 | A | * | 7/1881 | Fenby | 108/118 |
| 1,185,568 | A | * | 5/1916 | Zeunert | 5/115 |
| 1,312,299 | A | * | 8/1919 | Almen | 5/115 |
| 2,691,410 | A | * | 10/1954 | Boucher | 297/45 |
| 3,124,387 | A | * | 3/1964 | Maclaren | 297/16.2 |
| 3,136,272 | A | * | 6/1964 | Sprigman | 108/118 |
| 3,635,520 | A | | 1/1972 | Roher et al. | |
| 3,838,883 | A | * | 10/1974 | Machen | 297/16.2 |
| 4,123,809 | A | | 11/1978 | Pugh | |
| 4,124,188 | A | * | 11/1978 | Machen | 248/188.6 |
| D287,318 | S | | 12/1986 | Garduno | |
| 4,846,204 | A | * | 7/1989 | Sok Kyu | 5/113 |
| 5,234,224 | A | | 8/1993 | Kim | |
| 5,615,433 | A | | 4/1997 | Martin | |
| 5,765,487 | A | | 6/1998 | Neff | |
| 5,984,406 | A | * | 11/1999 | Lee | 297/16.2 |
| 6,082,813 | A | * | 7/2000 | Chen | 297/16.2 |
| 6,134,727 | A | * | 10/2000 | Hwang | 5/114 |
| 6,170,907 | B1 | * | 1/2001 | Tsai | 297/16.1 |
| 6,247,750 | B1 | * | 6/2001 | Tsai | 297/16.2 |
| 6,364,410 | B1 | * | 4/2002 | Tang | 297/16.2 |
| 6,378,445 | B1 | | 4/2002 | Willard, Sr. et al. | |
| 6,382,729 | B1 | * | 5/2002 | Wu | 297/16.2 |
| 6,446,282 | B1 | * | 9/2002 | Wu | 5/115 |
| 6,454,348 | B1 | * | 9/2002 | Wu | 297/16.2 |
| 6,457,192 | B2 | * | 10/2002 | Choi et al. | 5/114 |
| 6,564,402 | B1 | * | 5/2003 | Lin | 5/115 |
| 6,581,228 | B1 | | 6/2003 | Boskovich et al. | |
| 6,647,560 | B1 | * | 11/2003 | Hingley et al. | 4/484 |
| 6,711,761 | B2 | * | 3/2004 | Choi | 5/114 |
| 6,763,534 | B2 | * | 7/2004 | Hwang | 5/114 |
| 6,925,664 | B1 | * | 8/2005 | Twigg | 5/113 |
| 6,926,356 | B2 | | 8/2005 | Chen | |
| 6,966,084 | B2 | * | 11/2005 | Le Gette et al. | 5/129 |
| 7,089,610 | B2 | * | 8/2006 | Zhong | 5/122 |

(Continued)

*Primary Examiner*—Robert G Santos
(74) *Attorney, Agent, or Firm*—Morrison & Foerster LLP

(57) ABSTRACT

A collapsible and portable baby changing table has a collapsible frame and a changing pad. The collapsible frame has two sets of opposing sides. Each side has at least one pair of crossing support beams. The pair of crossing support beams is hinged where the crossing support beams cross. The crossing support beams have top ends and bottom ends. The collapsible frame is configured to be folded to a first position and unfolded to a second position. The changing pad is supported by the collapsible frame. When the collapsible frame is unfolded to the second position, the changing pad is contoured to cradle a baby's body when the baby is placed on the changing pad.

22 Claims, 5 Drawing Sheets

U.S. PATENT DOCUMENTS

| | | | | |
|---|---|---|---|---|
| 7,100,221 | B1 * | 9/2006 | Twigg | 5/113 |
| 7,114,205 | B2 * | 10/2006 | Choi | 5/114 |
| 7,272,865 | B2 * | 9/2007 | Le Gette et al. | 5/129 |
| 7,395,561 | B2 * | 7/2008 | Le Gette et al. | 5/127 |
| 7,422,276 | B2 * | 9/2008 | Flannery | 297/16.2 |
| 7,509,695 | B2 * | 3/2009 | Zheng | 5/116 |
| 7,540,259 | B2 * | 6/2009 | Pape et al. | 119/28.5 |
| 7,571,499 | B2 * | 8/2009 | Le Gette et al. | 5/127 |
| 2001/0054198 | A1 * | 12/2001 | Choi et al. | 5/114 |
| 2003/0019033 | A1 * | 1/2003 | Choi | 5/114 |
| 2004/0000009 | A1 * | 1/2004 | Choi | 5/174 |
| 2004/0034929 | A1 * | 2/2004 | Hwang | 5/114 |
| 2004/0206861 | A1 * | 10/2004 | Le Gette et al. | 248/166 |
| 2005/0060802 | A1 * | 3/2005 | Zhong | 5/120 |
| 2006/0070180 | A1 * | 4/2006 | Le Gette et al. | 5/120 |
| 2006/0150325 | A1 * | 7/2006 | Zheng | 5/127 |
| 2006/0282948 | A1 * | 12/2006 | Deng | 5/127 |
| 2007/0209113 | A1 * | 9/2007 | Le Gette et al. | 5/127 |
| 2008/0256703 | A1 * | 10/2008 | Le Gette et al. | 5/129 |
| 2009/0249546 | A1 * | 10/2009 | Yul et al. | 5/115 |
| 2009/0250978 | A1 * | 10/2009 | Reynolds | 297/16.2 |

* cited by examiner

COLLAPSIBLE AND PORTABLE BABY CHANGING TABLE

CROSS REFERENCE TO RELATED APPLICATION

This application claims the benefit of U.S. Provisional Application Ser. No. 60/847,704, which was filed on Sep. 27, 2006, which is incorporated herein by reference in its entirety for all purposes.

BACKGROUND

1. Field

The present application relates to baby changing tables, and, more particularly, to a baby changing table that is collapsible and portable.

2. Related Art

Baby changing stations are commonly used to change a baby's diaper. Conventional portable baby changing stations are typically configured to be placed on top of a flat surface, such as the perimeter of a sink. Unfortunately, it can be difficult, particularly when traveling, to locate a suitable surface on which to place the changing station. For example, when a designated changing station is not available in a public restroom, the changing station may need to be used on the floor or on the vanity, which can be unsanitary and unsafe. The floors of public restrooms often can be particularly filthy and disgusting. Also, using the changing station on a floor may be difficult for certain individuals, such as those with back problems, pregnant women, and the like.

SUMMARY

In one exemplary embodiment, a collapsible and portable baby changing table has a collapsible frame and a changing pad. The collapsible frame has two sets of opposing sides. Each side has at least one pair of crossing support beams. The pair of crossing support beams is hinged where the crossing support beams cross. The crossing support beams have top ends and bottom ends. The collapsible frame includes at least four top corners. Each top corner of the collapsible frame is formed by the top end of one crossing support beam of one side of the collapsible frame joined with the top end of another crossing support beam of another side of the collapsible frame. The collapsible frame includes at least four bottom corners. Each bottom corner of the collapsible frame is formed by the bottom end of one crossing support beam of one side of the collapsible frame joined with the bottom end of another crossing support beam of another side of the collapsible frame. The collapsible frame is configured to be folded to a first position in which the top and corners are nearest to each other and the bottom corners are nearest to each other. The collapsible frame is configured to be unfolded to a second position in which the top corners are farthest apart from each other and the bottom corners are farthest apart from each other. The changing pad is supported by the collapsible frame. When the collapsible frame is unfolded to the second position, the changing pad is contoured to cradle a baby's body when the baby is placed on the changing pad.

DESCRIPTION OF DRAWING FIGURES

The present application can be best understood by reference to the following description taken in conjunction with the accompanying drawing figures, in which like parts may be referred to by like numerals:

DETAILED DESCRIPTION

The following description sets forth numerous specific configurations, parameters, and the like. It should be recognized, however, that such description is not intended as a limitation on the scope of the present invention, but is instead provided as a description of exemplary embodiments.

Figure 1:
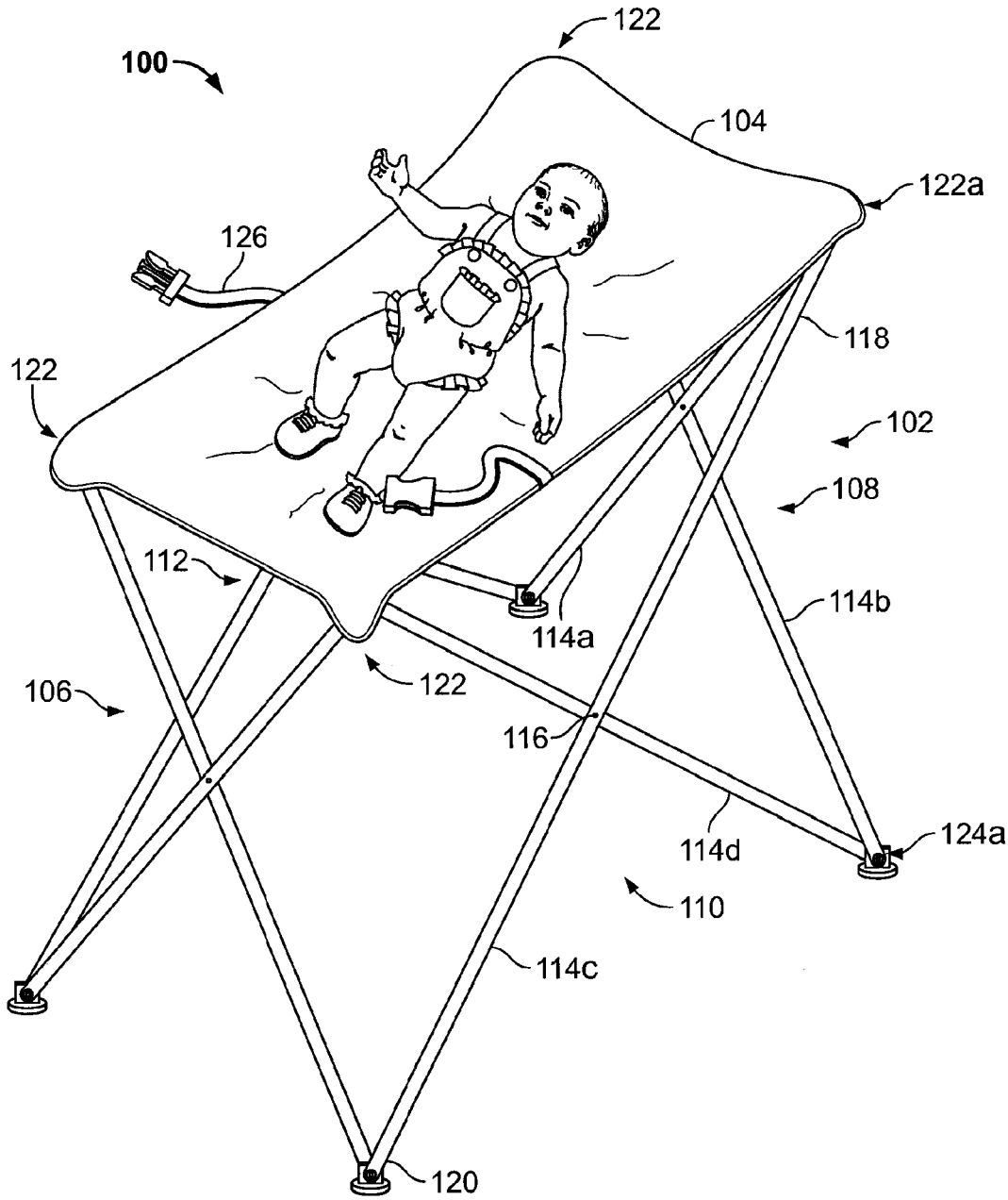
FIG. 1 is a perspective view of an exemplary collapsible and portable baby changing table in an unfolded position.

With reference to FIG. 1, an exemplary embodiment of a collapsible and portable baby changing table 100 is depicted. Changing table 100 includes a collapsible frame 102 and a flexible changing pad 104.

In the present exemplary embodiment, collapsible frame 102 has two sets of opposing sides. In the exemplary embodiment depicted in FIG. 1, a first side 106 opposes a second side 108, and a third side 110 opposes a fourth side 112.

As depicted in FIG. 1, each side 106, 108, 110, 112 have at least one pair of crossing support beams 114. For example, second side 108 has crossing support beams 114(*a*) and 114(*b*), and third side 110 has crossing support beams 114(*c*) and 114(*d*). Each pair of crossing support beams 114 is hinged at a point 116 where the crossing support beams 114 cross.

As also depicted in FIG. 1, each crossing support beam 114 has a top end 118 and bottom end 120. It should be recognized, however, that the terms top and bottom are not meant to require a particular orientation of a particular crossing support beam 114. For example, while top end 118 will generally be oriented toward the top end of collapsible frame 102, it should be recognized that if collapsible frame 102 is placed sideways, then top end 118 would not necessarily be oriented toward the top end of collapsible frame 102.

Collapsible frame 102 has four top corners 122. Each top corner 122 is formed by top end 118 of one crossing support beam 114 of one side of collapsible frame 102 joined with top end 118 of another crossing support beam 114 of another side of collapsible frame 102. For example, top corner 122(*a*) is formed between second side 108 and third side 110 by top end 118 of crossing support beam 114(*a*) of second side 108 and crossing support beam 114(*c*) of third side 110. In the present exemplary embodiment, top end 118 of one crossing support beam 114 of one side of collapsible frame 102 is hinged with top end 118 of another crossing support beam 118 of another side of collapsible frame 102.

Collapsible frame 102 has four bottom corners 124. Each bottom corner 124 is formed by bottom end 120 of one crossing support beam 114 of one side of collapsible frame 102 joined with bottom end 120 of another crossing support beam 114 of another side of collapsible frame 102. For example, bottom corner 124(*a*) is formed between second side 108 and third side 110 by bottom end 120 of crossing support beam 114(*b*) of second side 108 and bottom end 120 of crossing support beam 114(*d*) of third side 110. In the present exemplary embodiment, bottom end 120 of one crossing support beam 114 of one side of collapsible frame 102 is hinged with bottom end 120 of another crossing support beam 114 of another side of collapsible frame 102.

Figure 2:
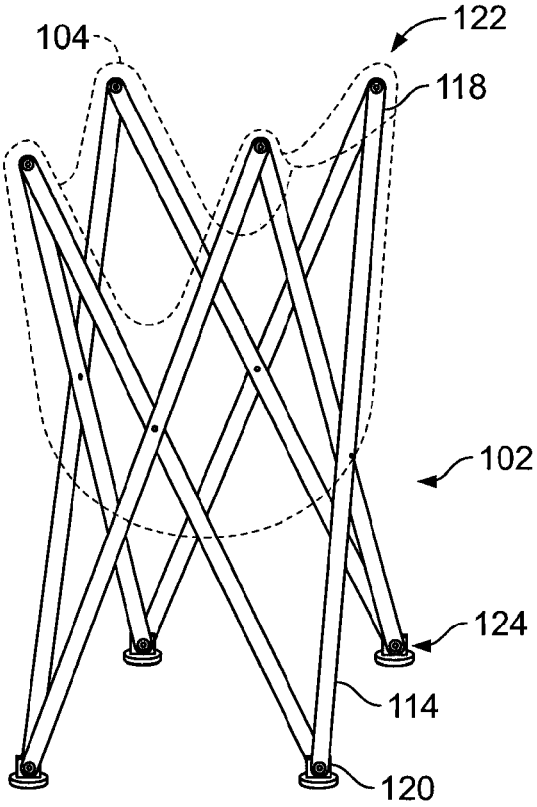
FIG. 2 is a perspective view of the exemplary changing table depicted in FIG. 1 in a folded position.

As depicted in FIGS. 1 and 2, collapsible frame 102 is configured to be folded and unfolded. As depicted in FIG. 2, when collapsible frame 102 is in the folded position, top corners 122 are closest together, and bottom corners 124 are closest together. In contrast, as depicted in FIG. 1, when collapsible frame 102 is in the unfolded position, the top corners 122 are farthest apart from each other, and bottom corners 124 are farthest apart from each other.

With continued reference to FIG. 1, changing pad 104 is supported by collapsible frame 102. In the present exemplary embodiment, changing pad 104 is supported by the four corners 122 of collapsible frame 102. When collapsible frame 102 is unfolded, changing pad 104 contours to cradle a baby's body when the baby is placed on the changing pad. Thus, in this manner, when a baby is placed on changing pad 104, the baby is cradled by changing pad 104, which helps to secure the baby without needing a harness. It should be recognized, however, that changing pad 104 can optionally include a harness 126 to further secure the baby to changing pad 104.

Figure 3:
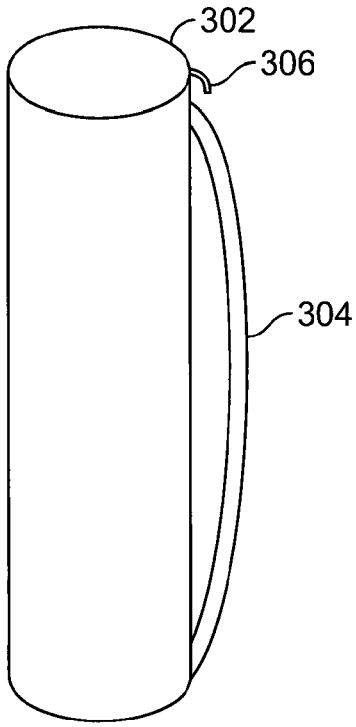
FIG. 3 is a perspective view of a carrying case.

With reference to FIG. 2, when collapsible frame 102 is folded, changing pad 104 also folds between crossing support beams 114 of collapsible frame 102. With reference to FIG. 3, once folded, changing table 100 can be placed into a carrying case 302. As depicted in FIG. 3, carrying case 302 can include a carrying strap 304 to allow a person to more conveniently carry changing table 102 (FIG. 2). Carry case 302 can also include a fastener 306, such as a hook. Thus, with or without carrying case 302, changing table 100 (FIG. 2) can be conveniently carried, folded, unfolded, and used without any assembly required. If changing table 100 (FIG. 2) is to be carried without carrying case 302, then a strap can be used to secure support beams 114.

Figure 4:
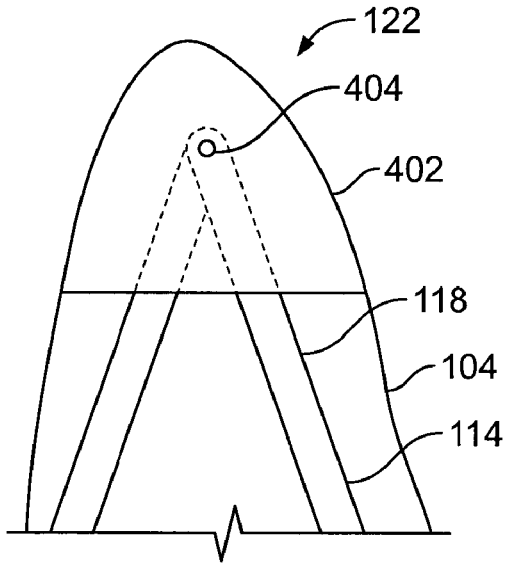
FIG. 4 is a side view of a portion of an exemplary changing table.

With reference to FIG. 4, in one exemplary embodiment, changing pad 104 includes a pocket 402 to removably secure changing pad 104 to collapsible frame 102. In the present exemplary embodiment, pocket 402 receives top corner 122. As depicted in FIG. 4, at top corner 122, a hinge 404 joins top ends 118 of two crossing support beams 114. In the present exemplary embodiment, pocket 402 can be sized to restrict the amount by which top ends 118 of the two crossing support beams 114 can separate, which in turn control the amount by which collapsible frame 102 (FIG. 1) unfolds.

Figure 5:
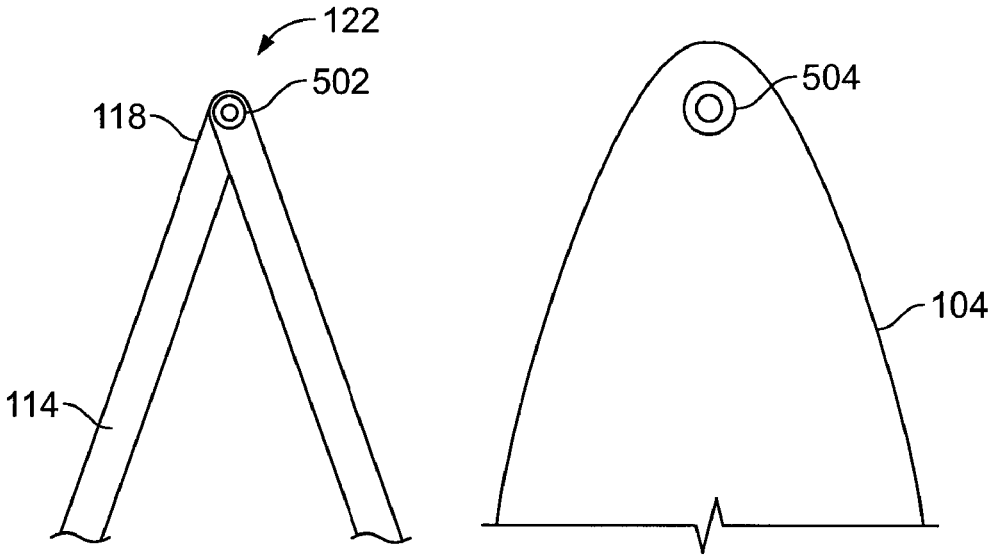
FIG. 5 is a side view of a portion of another exemplary changing table.

With reference to FIG. 5, in another exemplary embodiment, changing pad 104 can be removably secured to top corner 122 using a fastener. In particular, in the exemplary embodiment depicted in FIG. 5, a snap is used to secure changing pad 104 to top corner 122. The snap includes a stud portion 502 and a socket portion 504. While stud portion 502 is depicted as being disposed on top corner 122 and socket portion 504 is depicted as being disposed on changing pad 104, it should be recognized that stud portion 502 can be disposed on changing pad 104 and socket portion 504 can be disposed on top corner 122. It should also be recognized that various types of fasteners can be used to removably secure changing pad 104 to top corner 122.

In still another exemplary embodiment, changing pad 104 can be fixed to top corner 122. Thus, in this exemplary embodiment, changing pad 104 is not removable. Changing pad 104 can be formed from a material that is relatively easy to clean, such as lightweight vinyl. It should be recognized, however, that changing pad 104 can be formed from various materials.

Figure 6:
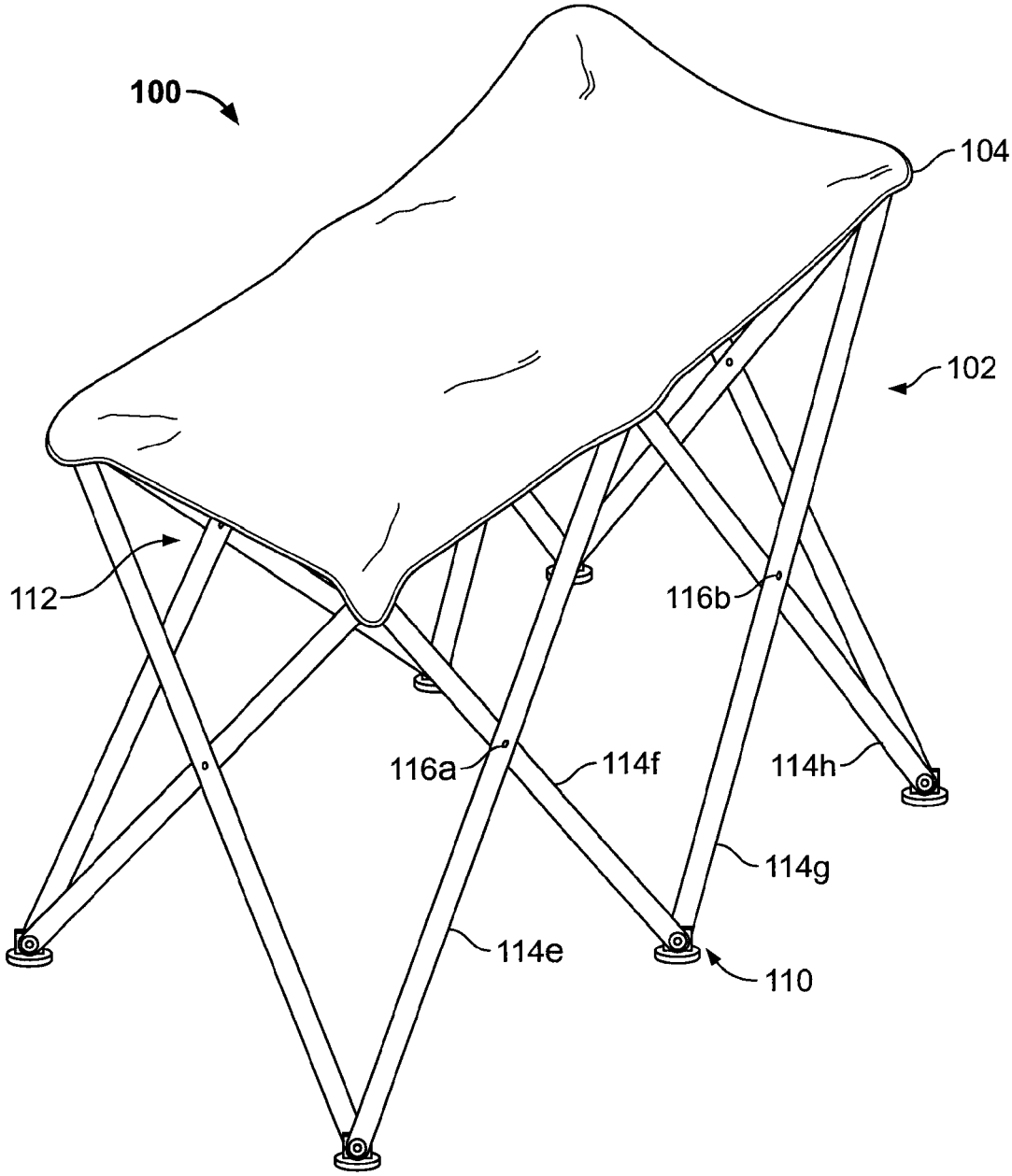
FIG. 6 is a perspective view of another exemplary changing table.

With reference to FIG. 6, in another exemplary embodiment, the sides of collapsible frame 102 can include two or more pairs of crossing support beams 114 to increase the strength of collapsible frame 102. In particular, in the exemplary embodiment depicted in FIG. 6, third side 110 and fourth side 112 each have two pairs of crossing support beams 114. Third side 110 has crossing beams 114(*e*) and 114(*f*) hinged at point 116(*a*) and crossing beams 114(*g*) and 114(*h*) hinged at point 116(*b*). Third side 110 and fourth sides 112 are longer than first side 106 and second side 108. Thus, the additional crossing support beams 114 help to strengthen the longer sides of collapsible frame 102. It should be recognized that the sides of collapsible frame 102 can include any number of pairs of crossing support beams 114.

In the present exemplary embodiment, collapsible frame 102 is configured to position changing pad 104 at a height of greater than about 28 inches from the ground or floor when collapsible frame 102 is unfolded. This height has the advantage of permitting an average person to change a baby using changing table 100 without having to excessively bend or reach. The height can be fixed using standard sized crossing support beams 114. Alternatively, the height of collapsible frame 102 can be varied to accommodate persons of different heights. For example, crossing support beams 114 can be telescoping to allow for their lengths to be adjusted.

In the present exemplary embodiment, collapsible frame 102 is formed from aluminum tubes, which are strong and light weight. It should be recognized, however, that collapsible frame 102 can be formed from any rigid material, including steel, alloys, composites, and the like.

In the present exemplary embodiment, changing pad 104 is formed from canvas, which is flexible and durable, and which can be layered with an easy-to-wipe lightweight vinyl material. It should be recognized, however, that changing pad 104 can be formed from various material, including lightweight vinyl, canvas, and the like.

Figure 7:
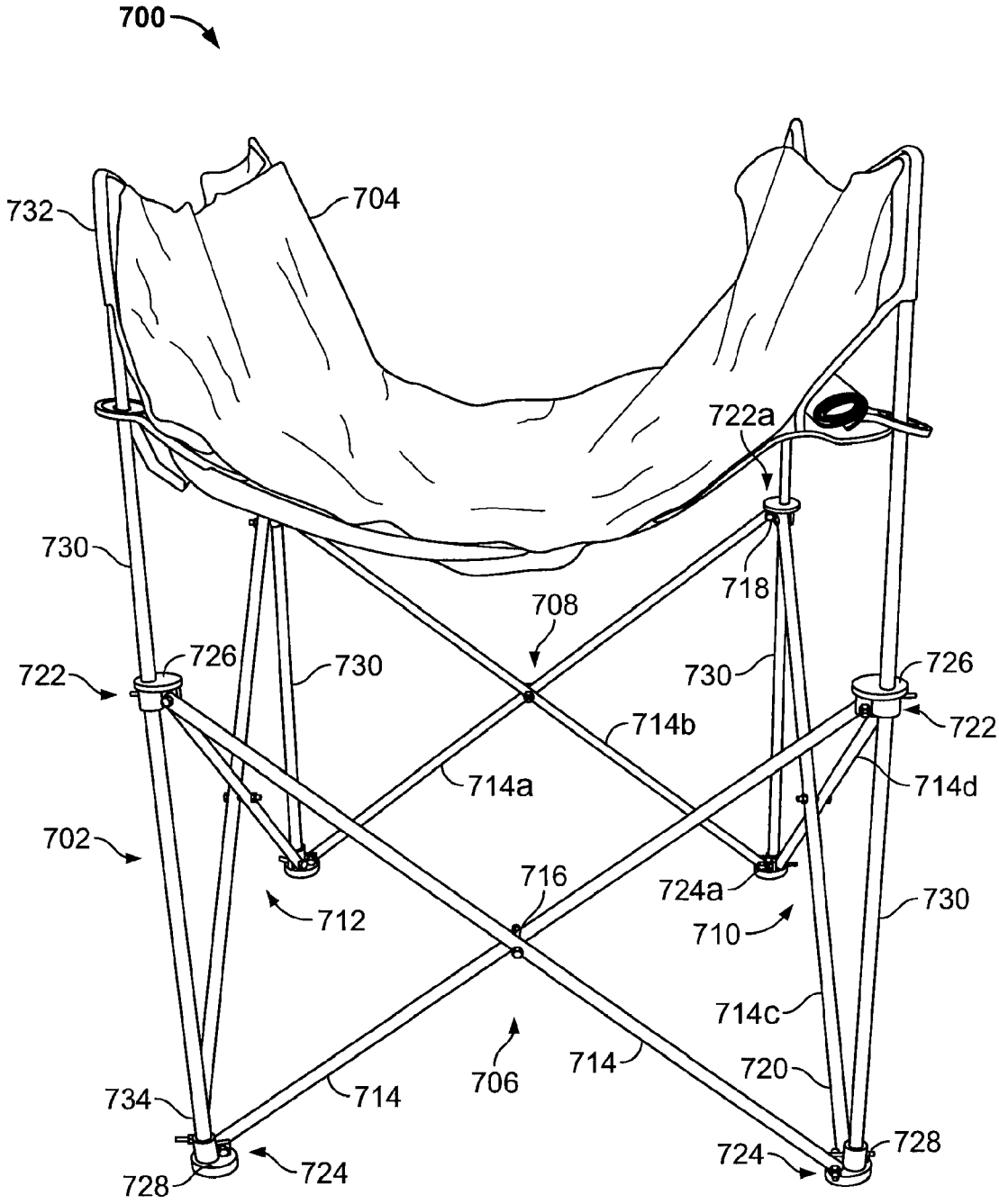
FIG. 7 is a perspective view of another exemplary changing table.

With reference to FIG. 7, another exemplary embodiment of a collapsible and portable baby changing table 700 is depicted. Changing table 700 includes a collapsible frame 702 and a flexible changing pad 704.

In the present exemplary embodiment, collapsible frame 702 has two sets of opposing sides. In the exemplary embodiment depicted in FIG. 7, a first side 706 opposes a second side 708, and a third side 710 opposes a fourth side 712.

As depicted in FIG. 7, each side 706, 708, 710, 712 have at least one pair of crossing support beams 714. For example, second side 708 has crossing support beams 714(*a*) and 714(*b*), and third side 710 has crossing support beams 714(*c*) and 714(*d*). Each pair of crossing support beams 714 is hinged at a point 716 where the crossing support beams 714 cross.

As also depicted in FIG. 7, each crossing support beam 714 has a top end 718 and bottom end 720. It should be recognized, however, that the terms top and bottom are not meant to require a particular orientation of a particular crossing support beam 714. For example, while top end 718 will generally be oriented toward the top end of collapsible frame 702, it should be recognized that if collapsible frame 702 is placed sideways, then top end 718 would not necessarily be oriented toward the top end of collapsible frame 702.

Collapsible frame 702 has four top corners 722. Each top corner 722 is formed by top end 718 of one crossing support beam 714 of one side of collapsible frame 702 joined with top end 718 of another crossing support beam 714 of another side of collapsible frame 702. For example, top corner 722(*a*) is formed between second side 708 and third side 710 by top end 718 of crossing support beam 714(*a*) of second side 708 and crossing support beam 714(*c*) of third side 710. In the present exemplary embodiment, top end 718 of one crossing support beam 714 of one side of collapsible frame 102 is joined to a slidable connector 726, which is joined with top end 718 of another crossing support beam 714 of another side of collapsible frame 702.

Collapsible frame 702 has four bottom corners 724. Each bottom corner 724 is formed by bottom end 720 of one crossing support beam 714 of one side of collapsible frame 702 joined with bottom end 720 of another crossing support beam 714 of another side of collapsible frame 702. For example, bottom corner 724(*a*) is formed between second side 708 and third side 710 by bottom end 720 of crossing support beam 714(*b*) of second side 708 and bottom end 720 of crossing support beam 714(*d*) of third side 710. In the present exemplary embodiment, bottom end 720 of one crossing support beam 714 of one side of collapsible frame 702 is joined to a connector 728, which is joined with bottom end 720 of another crossing support beam 714 of another side of collapsible frame 702.

Collapsible frame 702 is configured to be folded and unfolded. When collapsible frame 702 is in the folded position, top corners 722 are closest together, and bottom corners 724 are closest together. In contrast, when collapsible frame 702 is in the unfolded position, the top corners 722 are farthest apart from each other, and bottom corners 724 are farthest apart from each other.

In the exemplary embodiment depicted in FIG. 7, collapsible frame 702 includes four corner beams 730. Each corner beam 730 is located at each corner of collapsible frame 702. Each corner beam 730 has a top end 732 and a bottom end 734. Bottom end 734 of one corner beam 730 is joined with the bottom end of one crossing support beam of one side of collapsible frame 702 and the bottom end of another crossing support beam of another side of collapsible frame 702.

Each corner beam 730 is connected to a top corner 722 of collapsible frame 702. In particular, collapsible frame 702 includes four slidable connectors 726. One slidable connector 726 is disposed on each one of the four corner beams 730. Slidable connector 726 joins the top end of one crossing support beam of one side of collapsible frame 702 and the top end of another crossing support beam of another side of collapsible frame 702. Slidable connector 726 is configured to slide along corner beam 730.

With continued reference to FIG. 7, changing pad 704 is supported by collapsible frame 702. In the present exemplary embodiment, changing pad 704 is supported by top ends 732 of corner beams 730 of collapsible frame 702. Changing pad 704 can include at least four pockets disposed at four corners of changing pad 704. The top ends 732 of corner beams 730 can fit within these pockets to removably secure changing pad 704 to collapsible frame 702.

When collapsible frame 702 is unfolded, changing pad 704 contours to cradle a baby's body when the baby is placed on the changing pad. Thus, in this manner, when a baby is placed on changing pad 704, the baby is cradled by changing pad 704, which helps to secure the baby. In the present exemplary embodiment, changing pad 704 includes sides that extend upward several inches, such as 4-6 inches, to further secure the baby.

The foregoing descriptions of specific embodiments have been presented for purposes of illustration and description. They are not intended to be exhaustive, and it should be understood that many modifications and variations are possible in light of the above teaching.

I claim:

1. A collapsible and portable baby changing table comprising:

a collapsible frame having two sets of opposing sides, wherein each side comprises:

at least one pair of crossing support beams, wherein the pair of crossing support beams is hinged where the crossing support beams cross, wherein the crossing support beams have top ends and bottom ends, wherein the collapsible frame includes at least four top corners, wherein each top corner of the collapsible frame is formed by the top end of one crossing support beam of one side of the collapsible frame joined with the top end of another crossing support beam of another side of the collapsible frame, wherein the collapsible frame includes at least four bottom corners, wherein each bottom corner of the collapsible frame is formed by the bottom end of one crossing support beam of one side of the collapsible frame joined with the bottom end of another crossing support beam of another side of the collapsible frame, wherein the collapsible frame is configured to be folded to a first position in which the top corners are nearest to each other and the bottom corners are nearest to each other, and wherein the collapsible frame is configured to be unfolded to a second position in which the top corners are farthest apart from each other and the bottom corners are farthest apart from each other; and a changing pad supported by the collapsible frame, wherein the changing pad is attached to the collapsible frame with all points of attachment of the changing pad to the collapsible frame are approximately equidistant from the ground or floor when the collapsible frame is unfolded to the second position, wherein the collapsible frame is configured to position the changing pad at a height of greater than about 28 inches from the ground or floor when the collapsible frame is unfolded to the second position to permit an average person to change a baby without having to excessively bend or reach, and wherein the changing pad has a concave shape contoured to cradle a baby's body when the baby is placed on the changing pad with the collapsible frame unfolded to the second position.

2. The changing table of claim 1, further comprising:

a harness attached to the changing pad, wherein the harness is configured to secure the baby to the changing pad.

3. The changing table of claim 1, wherein the top end of one crossing support beam of one side of the collapsible frame is hinged with the top end of another crossing support beam of another side of the collapsible frame at each top end.

4. The changing table of claim 3, wherein the changing pad is removably secured to the at least four top corners.

5. The changing table of claim 4, wherein the changing pad includes at least four pockets disposed at four corners of the changing pad, wherein each of the at least four top corners fit within each of the at least four pockets to removably secure the changing pad to the at least four top corners.

6. The changing table of claim 4, wherein each of the at least four top corners includes a first fastener, wherein each of at least four corners of the changing pad includes a second fastener, and wherein the first and second fasteners removably secure the changing pad to the at least four top corners.

7. The changing table of claim 3, wherein the changing pad is fixed to the at least four top corners.

8. The changing table of claim 1, two opposing sides of the two sets of opposing sides each comprises:

a first pair of crossing support beams, wherein the first pair of crossing support beams is hinged where the crossing support beams cross, and wherein the crossing support beams have top ends and bottom ends; and a second pair of crossing support beams, wherein the second pair of crossing support beams is hinged where the crossing support beams cross, and wherein the crossing support beams have top ends and bottom ends, wherein a first top end of the first pair of crossing support beams forms one of the at least four top corners of the collapsible frame, wherein a first top end of the second pair of crossing support beams forms another of the at least four top corners of the collapsible frame, and wherein a second top end of the first pair of crossing support beams and a second top end of the second pair of crossing support beams are joined together.

9. The changing table of claim 8, wherein the changing pad is supported by the second top ends of the first and second pairs of crossing support beams.

10. The changing table of claim 1, further comprising:

four corner beams, each corner beam located at each corner of the collapsible frame, each corner beam having a top end and a bottom end, wherein the bottom end of one corner beam is joined with the bottom end of one crossing support beam of one side of the collapsible frame and the bottom end of another crossing support beam of another side of the collapsible frame, wherein one corner beam is connected to one top corner of the collapsible frame, and wherein the top ends of the corner beams support the changing pad.

11. The changing table of claim 10, further comprising:

four slidable connectors, one slidable connector disposed on each one of the four corner beams, wherein the one slidable connector joins the top end of one crossing support beam of one side of the collapsible frame and the top end of another crossing support beam of another side of the collapsible frame, and wherein the one slidable connector is configured to slide along the corner beam on which it is disposed.

12. The changing table of claim 10, wherein the changing pad includes at least four pockets disposed at four corners of the changing pad, wherein the top ends of each of the four corner beams fit within each of the at least four pockets to removably secure the changing pad to the collapsible frame.

13. A method of using a collapsible and portable baby changing table, the changing table comprising:

a collapsible frame having two sets of opposing sides, wherein each side comprises:

at least one pair of crossing support beams, wherein the pair of crossing support beams is hinged where the crossing support beams cross, wherein the crossing support beams have top ends and bottom ends, wherein the collapsible frame includes at least four top corners, wherein each top corner of the collapsible frame is formed by the top end of one crossing support beam of one side of the collapsible frame joined with the top end of another crossing support beam of another side of the collapsible frame, wherein the collapsible frame includes at least four bottom corners, wherein each bottom corner of the collapsible frame is formed by the bottom end of one crossing support beam of one side of the collapsible frame joined with the bottom end of another crossing support beam of another side of the collapsible frame; and a changing pad supported by the collapsible frame, wherein the changing pad is attached to the collapsible frame with all points of attachment of the changing pad to the collapsible frame approximately equidistant from the ground or floor when the collapsible frame is unfolded to the second position, wherein the collapsible frame is configured to position the changing pad at a height of greater than about 28 inches from the ground or floor when the collapsible frame is unfolded to the second position to permit an average person to change a baby without having to excessively bend or reach, wherein the method of using the changing table comprises:

unfolding the collapsible frame from a first position, in which the top corners are nearest to each other and the bottom corners are nearest to each other, to a second position, in which the top corners are farthest apart from each other and the bottom corners are farthest apart from each other and the changing pad has a concave shape contoured to cradle a baby's body when the baby is placed on the changing pad.

14. A method of making a collapsible and portable baby changing table, comprising:

obtaining a collapsible frame having two sets of opposing sides, wherein each side comprises:

at least one pair of crossing support beams, wherein the pair of crossing support beams is hinged where the crossing support beams cross, wherein the crossing support beams have top ends and bottom ends, wherein the collapsible frame includes at least four top corners, wherein each top corner of the collapsible frame is formed by the top end of one crossing support beam of one side of the collapsible frame joined with the top end of another crossing support beam of another side of the collapsible frame, wherein the collapsible frame includes at least four bottom corners, wherein each bottom corner of the collapsible frame is formed by the bottom end of one crossing support beam of one side of the collapsible frame joined with the bottom end of another crossing support beam of another side of the collapsible frame, wherein the collapsible frame is configured to be folded to a first position in which the top corners are nearest to each other and the bottom corners are nearest to each other, and wherein the collapsible frame is configured to be unfolded to a second position in which the top corners are farthest apart from each other and the bottom corners are farthest apart from each other;

obtaining a changing pad; and attaching the changing pad to the collapsible frame, wherein the changing pad is supported by the collapsible frame, wherein the changing pad is attached to the collapsible frame with all points of attachment of the changing pad to the collapsible frame approximately equidistant from the ground or floor when the collapsible frame is unfolded to the second position to permit an average person to change a baby without having to excessively bend or reach, wherein the collapsible frame is configured to position the changing pad at a height of greater than about 28 inches from the ground or floor when the collapsible frame is unfolded to the second position, wherein the changing pad has a concave shape contoured to cradle a baby's body when the baby is placed on the changing pad with the collapsible frame unfolded to the second position.

15. The method of claim 14, wherein the top end of one crossing support beam of one side of the collapsible frame is hinged with the top end of another crossing support beam of another side of the collapsible frame at each top end.

16. The method of claim 15, wherein the changing pad is removably secured to the at least four top corners.

17. The method of claim 16, wherein the changing pad includes at least four pockets disposed at four corners of the changing pad, wherein each of the at least four top corners fit within each of the at least four pockets to removably secure the changing pad to the at least four top corners.

18. The method of claim 16, wherein each of the at least four top corners includes a first fastener, wherein each of the at least four corners of the changing pad includes a second fastener, and wherein the first and second fasteners removably secure the changing pad to the at least four top corners.

19. The method of claim 16, wherein the changing pad is fixed to the at least four top corners.

20. The method of claim 14, wherein the collapsible frame further comprises:

four corner beams, each corner beam located at each corner of the collapsible frame, each corner beam having a top end and a bottom end, wherein the bottom end of one corner beam is joined with the bottom end of one crossing support beam of one side of the collapsible frame and the bottom end of another crossing support beam of another side of the collapsible frame, wherein one corner beam is connected to one top corner of the collapsible frame, and wherein the top ends of the corner beams support the changing pad.

21. The method of claim 20, wherein the collapsible frame further comprises:

four slidable connectors, one slidable connector disposed on each one of the four corner beams, wherein the one slidable connector joins the top end of one crossing support beam of one side of the collapsible frame and the top end of another crossing support beam of another side of the collapsible frame, and wherein the one slidable connector is configured to slide along the corner beam on which it is disposed.

22. The method of claim 20, wherein the changing pad includes at least four pockets disposed at four corners of the changing pad, wherein the top ends of each of the four corner beams fit within each of the at least four pockets to removably secure the changing pad to the collapsible frame.

* * * * *